US005993270A

United States Patent [19]

Geske et al.

[11] Patent Number: 5,993,270

[45] Date of Patent: Nov. 30, 1999

[54] ELECTRIC ELASTIC CLAMP

[75] Inventors: Ralf Geske, Hameln, Germany; Hervé Grillot, Longvic les Dijon, France; Jean-Luc Bouchard, Dijon, France; Christian Pichard, Asniéres les Dijon, France

[73] Assignees: Phoenix Contact GmbH & Co., Blomberg, Germany; Schneider Electric S.A., Boulogne Billancourt, France

[21] Appl. No.: 09/129,171

[22] Filed: Aug. 5, 1998

[30] Foreign Application Priority Data

Aug. 14, 1997 [EP] European Pat. Off. ..... 97114045

[51] Int. Cl.[6] ..... H01R 4/48

[52] U.S. Cl. ..... 439/835

[58] Field of Search ..... 439/835, 817, 439/729

[56] References Cited

U.S. PATENT DOCUMENTS 4,708,417 11/1987 Woertz ..... 439/835

*Primary Examiner*—Neil Abrams
*Assistant Examiner*—Javaid Nasri
*Attorney, Agent, or Firm*—Charles E. Baxley Esq.

[57] ABSTRACT

Such a clamp has a clamping spring (5) and a busbar (4) on which the pretensioned clamping spring (5) can be placed. One end leg (8) of the clamping spring (5) has a window (9) penetrated by the tongue of the busbar (4), and a spring-tensioned electrical conductor can be fixed between a front edge (12) and the busbar (4). The other end section (14) of the clamping spring (5) abuts a brace of the busbar (4), and the spring forms a flexible joint (6) between its end leg (8) and the end section (14). To make the design and installation simpler, the clamping spring (5) is bent essentially in the form of a circular arc section at its flexible joint (6). Its end leg (8) and end section (14) are bent away from the open side (7) of the arc-shaped flexible joint (6), and the tongue (10) and brace (15) are in a respectively adapted position on the busbar (4).

7 Claims, 3 Drawing Sheets

ELECTRIC ELASTIC CLAMP

FIELD OF THE INVENTION

The invention concerns an electric elastic clamp with a bent clamping spring made of a flat metal strip and with a busbar on which the pretensioned clamping spring can be placed, and one end leg of the clamping spring has an elongated window through which a tongue of the busbar extends that is to move the end leg. One front edge that may clamp an electrical conductor rests on the busbar tongue under spring tension. The busbar has a brace to support the other end section of the clamping spring that forms a flexible joint between the end leg and the end section.

BACKGROUND OF THE INVENTION

In a prior art design of such elastic clamps, the clamping spring is a closed or even intertwined design as, for example, found in German utility model DE 295 14 509 U1. This makes the clamping spring expensive to manufacture, and installation is difficult because the overlapping or engaging end sections of the clamping spring make it difficult to join with the busbar, especially inserting the busbar tongue through the window in the relevant end leg.

SUMMARY OF THE INVENTION

The invention is therefore based on the problem of creating an elastic clamp of the initially-cited kind that has a simpler construction and is easier to install.

This problem is solved with a generic elastic clamp according to the invention in that the clamping spring is bent at its flexible joint essentially in the form of an arc section and then runs in a semicircle or approximate semicircle, and the end leg and end section of the clamping spring are bent away from the open side of the approximately arced flexible joint, and the tongue and the brace of the busbar are in a respectively-adapted position.

The special shape of the clamping spring is essential to the invention; its central bent area is approximately designed as a ring open on one side, and the ends of the clamping spring bent away from each other (i.e., the end leg with the window and the end section) can be pressed together manually while narrowing the open side of the flexible joint which allows the clamping spring to be suspended between the tongue and the brace of the busbar. After the ends are released, the clamping spring expands under its spring force and independently rests under tension between the busbar tongue and the brace. In addition, the shape of the clamping spring is particularly simple and easy to manufacture since there are no spring sections that are entwined or rolled in each other.

In one advantageous embodiment of the invention, the central flexible joint of the clamping spring extends along a ¾ circle. This yields a sufficient opening width at the open side of the clamping spring to press the ends of the clamping spring together during installation. It is also to be understood that, precisely speaking, the clamping spring which is formed from a flat metal strip is not a circular arc but is cylindrical, and "circular arc" only describes the basic shape of the standing clamping spring that is wide as the strip; the basic shape would also be circular if the spring were a cylinder.

To attain the maximum clamping force in one embodiment of the invention, the end leg of the clamping spring with the window is located along the tangent on the theoretically lengthened circular arc over the open side of the busbar. To adapt the space in the housing for the relevant elastic clamp, it can be advantageous to place between the flexible joint and the outward-bent end section an essentially straight section of the clamping spring without departing from the basic concept of the invention. To save room, it is useful to place the busbar next to the clamping spring parallel to the circular plane expanded by its flexible joint. There is an angled section extending from the busbar with a projecting busbar tongue, and the brace is also angled.

The clamping spring of the elastic clamp according to the invention is actuated by pressing on the free end of the end leg of the clamping spring with the window tangential to the circular arc of the flexible joint of the clamping spring. Special positive locks can be provided in the busbar to allow the clamping spring to retain its set position upon contracting and especially upon relaxing. A support part with a guide contour for engaging the clamping spring can be provided in the busbar or its angled section that extends over the width of the clamping spring. With a brace designed as a tab angling away from the busbar can be provided that has a contour for receiving the end section of the clamping spring.

BRIEF DESCRIPTION OF THE DRAWINGS

The invention will be further explained in the following using an exemplary embodiment with reference to the drawings. Shown are.

DETAILED DESCRIPTION OF THE INVENTION

Figure 1:
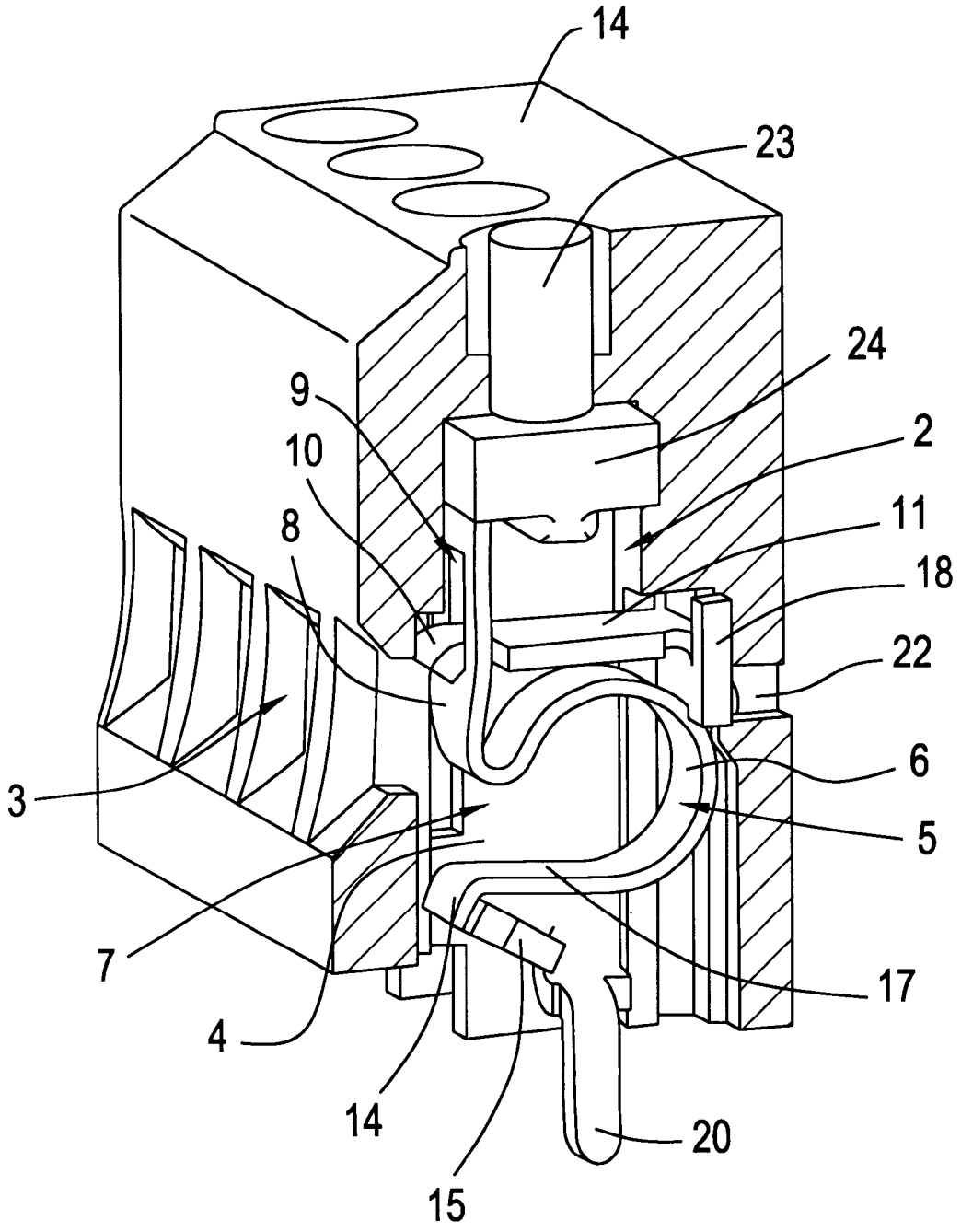
FIG. 1 Perspective view of a cut-away clamp housing with a revealed elastic clamp, FIG. 2 A perspective view of the clamping spring for the elastic clamp from FIG. 1, and FIG. 3 A perspective view of the busbar of the elastic clamp from FIG. 1.

In particular, FIG. 1 shows a clamp housing 1 in which numerous elastic clamps are located.

Each of these elastic clamps is in a cavity 2 in the housing 1 where the electrical conductor to be clamped is introduced through openings 3 in the side of the housing 1. In the portrayed standing arrangement, a busbar 4 is introduced from below into the relevant cavity 2 of the housing 1 on which is a pretensioned clamping spring 5. The busbar 4 and the clamping spring 6 as portrayed in FIG. 1 are a prefabricatable unit whose two individual parts are shown in FIG. 2 and 3.

Figure 2:
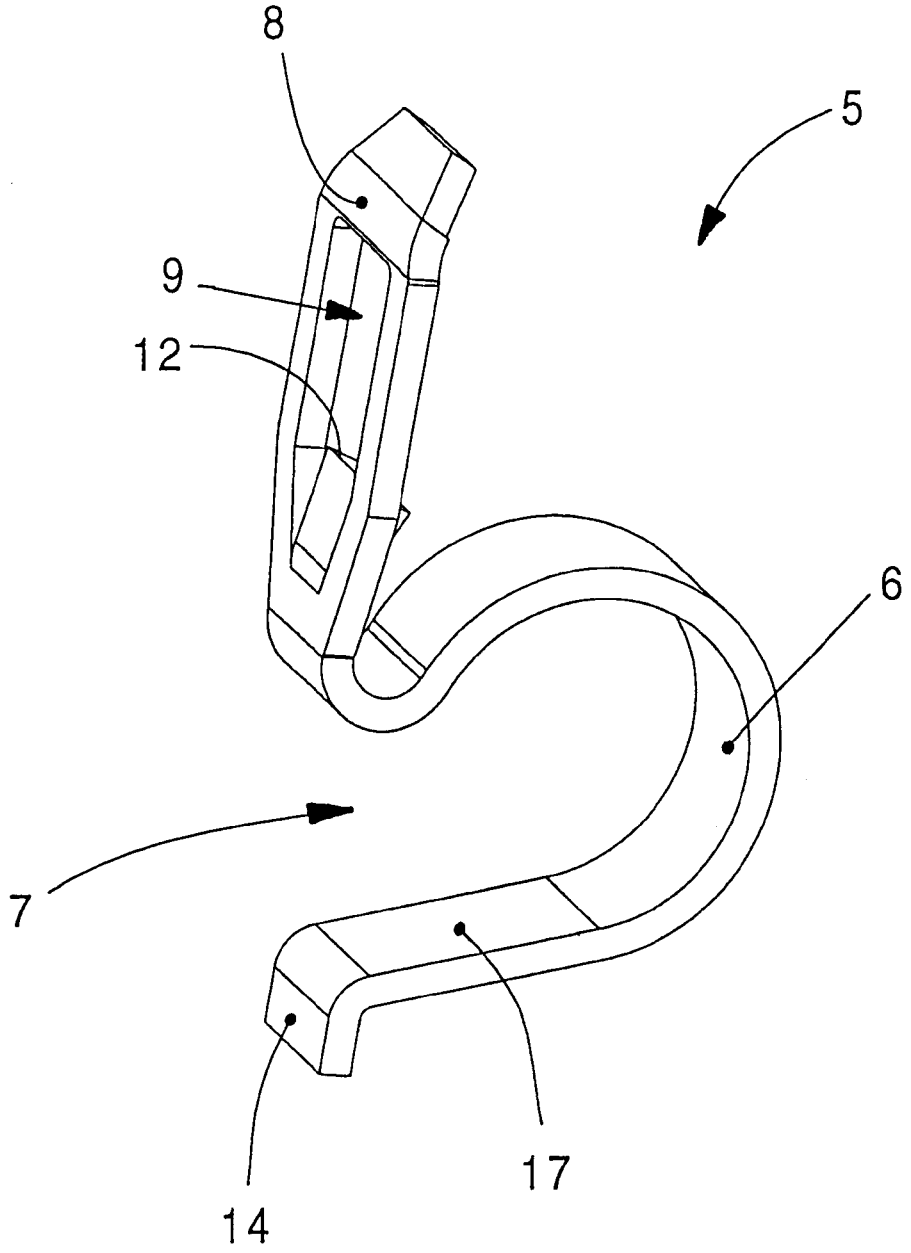
Figure 3:
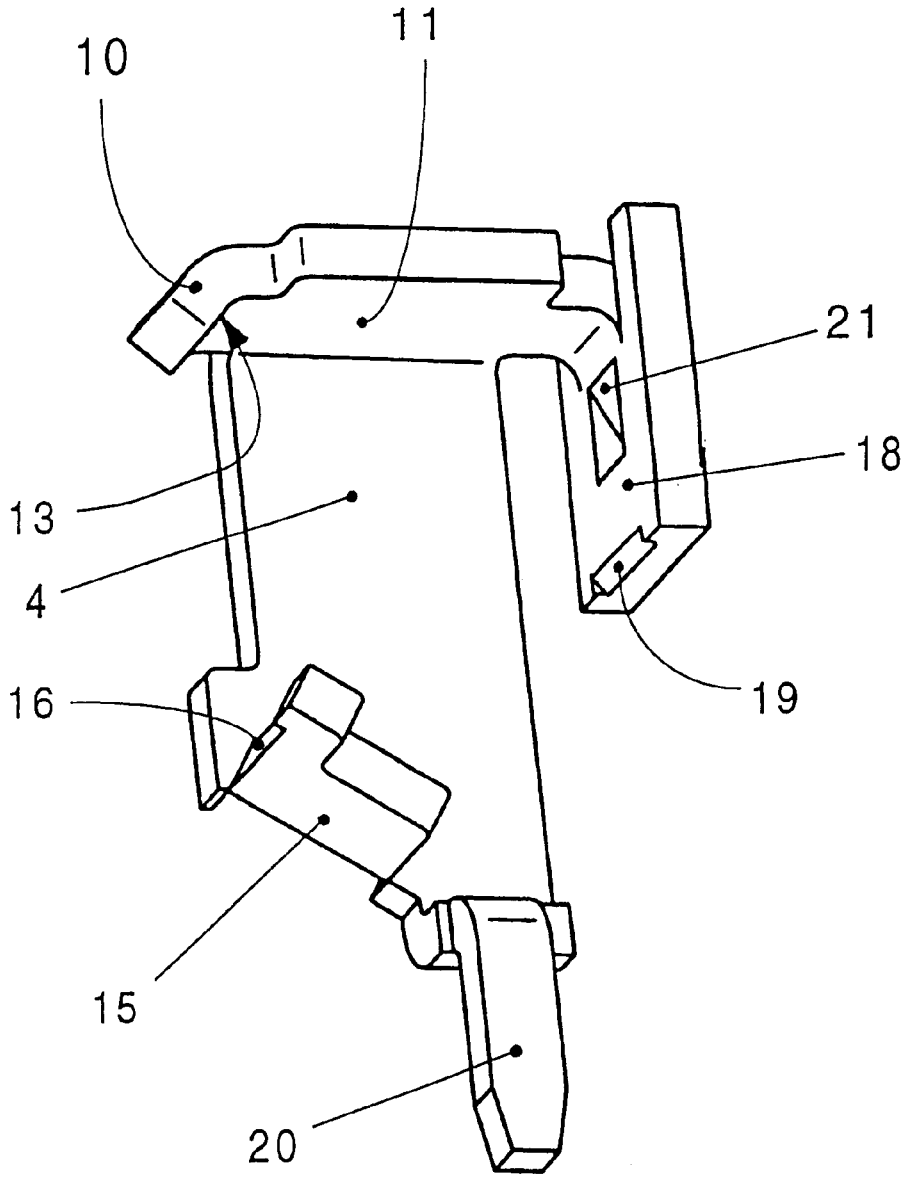

As can be seen in FIG. 2 in particular, the clamping spring 6 has a central, bent area that represents a flexible joint 6. The flexible joint 6 basically has the shape of a ring that is ¾ closed and correspondingly has an open side 7 whose width is greater or lesser depending on whether or not the clamping spring 5 is squeezed. The curve of the flexible joint 6 essentially runs along a circular arc section. Deviations from an exact circle can result depending on whether the clamping spring 5 assumes a more or less clamped or relaxed position. In FIG. 2, the clamping spring 5 is in a relaxed position, whereas it is in a pretensioned state in the installed position in FIG. 1.

The clamping spring 5 consisting of a flat metal strip, especially a steel strip, has an end leg 8 on one end that essentially runs along a tangent that lies on the circle described by the flexible joint 6 when the circle is extended through the open side 7 of the clamping spring 5.

Opposite the clamping joint 6, the end leg 8 of the clamping spring 5 is bent outward so that the end leg 8 of the clamping spring 5 extends away from the open side 7.

In the end leg 8 of the clamping spring 5 is a window 9 that has a front edge 12 on the side facing the open side 7 of the flexible joint 6 serving as a clamping edge. In the arrangement joined with the busbar 4, a busbar tongue 10 extends through this window 9 as illustrated in FIG. 1. This tongue 10 of the busbar 4 has an inner or bottom clamping side 13 as can be seen in FIG. 3. The clamping spring 5 with the face 12 of the window 9 in the end leg 8 elastically presses against this clamping side 13 of the busbar tongue 10. An electrical conductor can be clamped between the front edge 12 and the clamping side 13. To introduce such a conductor into the described clamped position, the end leg 8 of the clamping spring 5 can be moved approx. tangentially to the arc-shaped flexible joint 6. The window 9 in the end leg 8 is elongated so that the end leg 8 can be moved perpendicular to the busbar tongue 10. The front edge 12 of the window 9 of the end leg 8 is thereby released from the clamping side 13 of the busbar tongue 10 so that the conductor can be inserted between the two clamping partners. When the end section 8 is moved, the clamping spring 5 clamps, and the width of the open side 7 and the diameter of the flexible joint 6 are correspondingly reduced.

To clamp and release a conductor, the end leg 8 of the clamping spring 5 is squeezed or released from the outside. There is a moveable press button 23 with a guide piece 24 in the housing. The clamping spring 5 abuts the guide piece 24 of the press button 23 with the end of its end leg 8 as is shown in FIG. 1.

The majority of the busbar 4 and the clamping spring 5 are adjacent, i.e., the majority of the busbar 4 is essentially parallel to the plan defined by the arc section of the flexible joint 6 of the clamping spring 5. For the clamping spring 5 to be held by the busbar 4, supports extend from the busbar into the cited plane that is defined by the arc section of the flexible joint 6 of the clamping spring 5. This is portrayed with particular clarity in FIG. 3. The busbar tongue 10 is on an angled section 11 that grips the top of the flexible joint 6. The angled section is bent at a right angle away from the busbar 4 and extends lengthwise approximately at a right angle to the end leg 8 of the clamping spring 5 when in a joined position. As a counterbrace, the clamping spring 5 has an end section 14 on its second end that is also bent away from the open side 7 of the flexible joint. In its inserted position, the clamping spring 5 grips a brace 15 in the form of a tag that bends at a right angle from the busbar 4. The end section 14 of the clamping spring 5 grips the top narrow side of the brace 15 that has a seat 16 the width of the end section 14 of the clamping spring 5 to fit the shape of the end section 14 of the clamping spring 5. Depending on the position of the brace 15 on the busbar 4, there can be a straight section 17 between the arcing flexible joint 6 and the end section 14 of the clamping spring 5 to ensure that the open side 7 of the flexible joint 6 is sufficiently wide given a set curvature of the metal strip forming the clamping spring 6.

A similar positive lock or guide for the clamping spring 5 can be provided in the side crest of the flexible joint 6. A projecting support piece 18 is formed in the busbar 4 or its angled section 11 that extends past the side of the flexible joint 6 of the clamping spring 5, and it has a greater width than the clamping spring 5. On the free end of the support part 18 is a seat 16 on the side facing the flexible joint 6 in which the clamping spring 5 with its flexible joint 6 can grip to prevent undesirable shifting of the clamping spring 5 along its width. Before the busbar 4 is inserted in the housing 1, the clamping spring 5 can be suspended with pretension in the inner area of the busbar 4 defined by the brace 15, the angled section 11 and the support 18 by pressing the free ends of the end leg 8 and the end section of the 14 of the clamping spring 5. The window 9 of the end leg 8 can be easily engaged with the busbar tongue 10. By releasing the clamping spring 5, the end section 14 can be suspended in the seat 16 of the brace 15 in the busbar 4 to fix it under pretension in the busbar 4.

The overall housing 1 with all the elastic clamps can e.g. be placed on a plate. A contact pin 7 on the busbar that projects downward serves to connect the respective busbar 4. To secure the busbar 4 in the housing 1, there can be an outward-projecting catch tongue 21 on its support part 18 (see FIG. 3) that engages in a through hole 22 in the housing 1 (see FIG. 1) through which can also be inserted a test pin on the support part 18 that forms a single piece with the busbar 4.

We claim:

1. An electrical elastic clamp comprising:

a busbar (4), with said busbar comprising:
a tongue (10); and
a brace (15);

a bent clamping spring with said bent clamping spring comprising:
an end leg (8), with said end leg containing an elongated window (9) and with said tongue (10) of said busbar (4) extending through said window (9) for the purpose of moving said end leg with said window having a front edge disposed bearing on said tongue (10);
an end section (14), with said end section supported by said brace (15);
a flexible joint portion (6) formed between said leg (8) and said end section (14), with said flexible joint bent in the form of an arc, having an open side, with said end leg (8) and said end section (14) of said clamping spring each bent in a direction away from said open side.

2. The elastic clamp as claimed in claim 1, wherein said arc formed by said flexible joint is generally circular in shape and has a length equivalent to less than a full circle.

3. The elastic clamp as claimed in claim 1, wherein said flexible joint is formed as a circular arc and said end leg (8) is disposed to lie on a tangent to said circular arc.

4. The elastic clamp as claimed in claim 1, wherein there is an essentially straight section (17) of the clamping spring (5) between the flexible joint (6) and the outward-bent end section (14).

5. The elastic clamp as claimed in claim 1, wherein the busbar (4) next to the clamping spring (5) is generally parallel to the circular plane defined by its flexible joint (6), and comprising an angled section (11) extending from the busbar (4) with the projecting busbar tongue (10), and the brace also angled (15).

6. The elastic clamp as claimed in claim 5, wherein there is a support part (18) projecting beyond the width of the clamping spring (5) on the busbar (4) shaped as a guide (19) to engage the clamping spring (5).

7. The elastic clamp as claimed in claim 5, wherein the brace (15) is in the form of a tab angled away from the busbar (4) and the brace further comprises a seat (16) on the end section (14) of the clamping spring (5).

* * * * *